US012213639B2

(12) United States Patent
Cruz et al.

(10) Patent No.: US 12,213,639 B2
(45) **Date of Patent: *Feb. 4, 2025**

(54) FOOTWEAR CLEANING DEVICE

(71) Applicant: Oscar Cruz, Oxnard, CA (US)

(72) Inventors: Oscar Cruz, Oxnard, CA (US); Leo Bravo, Oxnard, CA (US)

(73) Assignee: Oscar Cruz, Oxnard, CA (US)

( * ) Notice: Subject to any disclaimer, the term of this patent is extended or adjusted under 35 U.S.C. 154(b) by 524 days.

This patent is subject to a terminal disclaimer.

(21) Appl. No.: 15/469,417

(22) Filed: Mar. 24, 2017

(65) Prior Publication Data

US 2017/0196433 A1 Jul. 13, 2017

Related U.S. Application Data

(63) Continuation of application No. 14/575,631, filed on Dec. 18, 2014, now Pat. No. 9,603,504.

(51) Int. Cl.

| | |
|---|---|
| ***A47L 23/02*** | (2006.01) |
| ***A46B 13/00*** | (2006.01) |
| ***A46B 13/04*** | (2006.01) |

(52) U.S. Cl.

CPC ..... *A47L 23/02* (2013.01); *A46B 13/001* (2013.01); *A46B 13/04* (2013.01); *A46B 2200/306* (2013.01)

(58) Field of Classification Search

CPC ..... A47L 23/02; A47L 23/26; A47L 23/263

See application file for complete search history.

(56) References Cited

U.S. PATENT DOCUMENTS

| | | | | |
|---|---|---|---|---|
| 2,723,408 | A * | 11/1955 | Peiker | A47L 23/02 15/31 |
| 3,802,021 | A * | 4/1974 | Schulz | A43D 1/08 15/36 |
| 3,925,830 | A * | 12/1975 | Delaney | A47K 3/022 4/615 |
| 5,025,528 | A * | 6/1991 | Burey | A47L 23/02 15/179 |
| 6,668,842 | B1 * | 12/2003 | Wilke | A47L 23/02 134/113 |

(Continued)

FOREIGN PATENT DOCUMENTS

DE 44 08 079 * 6/1995

*Primary Examiner* — Randall E Chin

(74) *Attorney, Agent, or Firm* — Bold IP PLLC; Christopher Mayle

(57) ABSTRACT

Various apparatus for cleaning footwear are described. One footwear cleaning apparatus includes a box having an open top surface for receiving a piece of footwear; and a plurality of brushes arrayed within the box and positioned substantially parallel to a bottom surface of the box, wherein the plurality of brushes includes at least one first brush configured to contact a first side surface of the piece of footwear, at least one second brush configured to contact a different, second side surface of the piece of footwear, and at least one third brush configured to contact a bottom surface of the piece of footwear, and wherein the at least one first brush and the at least one second brush are configured to, when actuated, rotate towards a center of the box about an axis that is substantially parallel to the bottom surface of the box.

17 Claims, 4 Drawing Sheets

(56) References Cited

U.S. PATENT DOCUMENTS

| | | | | |
|---|---|---|---|---|
| 8,631,533 | B1 * | 1/2014 | Gulian | A61L 2/10 15/36 |
| 9,380,927 | B2 * | 7/2016 | Nappi, Sr. | A47L 23/26 |
| 9,603,504 | B2 * | 3/2017 | Cruz | A47L 23/02 |
| 2009/0199867 | A1 * | 8/2009 | Woods | A47L 23/02 134/6 |
| 2010/0115717 | A1 * | 5/2010 | Vogt | A47L 23/263 15/4 |
| 2015/0289746 | A1 * | 10/2015 | Thompson | A47L 23/02 15/36 |

* cited by examiner

FOOTWEAR CLEANING DEVICE

CROSS-REFERENCE TO RELATED APPLICATION

This application is a continuation of pending U.S. patent application Ser. No. 14/575,631, filed Dec. 18, 2014, entitled "Footwear Cleaning Device", the entire contents of which are hereby incorporated by reference.

BACKGROUND

This specification relates to an apparatus for cleaning footwear.

Shoes, boots, and other footwear tend to attract debris after being worn for any amount of time. For example, shoes worn while playing sports on a grass field or while working on a construction site may become covered with dust, dirt, or other debris. Some of the debris may be debris that is easily removed using a dry clean, e.g., dust on a top surface of a shoe, while other debris may be debris that can only be effectively removed using a wet clean, e.g., dirt caked on a bottom surface of a shoe or trapped in a crease on the bottom surface of the shoe.

SUMMARY

In general, one innovative aspect of the subject matter described in this specification can be embodied in an apparatus that includes a box having an open top surface for receiving a piece of footwear; and a plurality of brushes arrayed within the box and positioned substantially parallel to a bottom surface of the box, wherein each of the plurality of brushes is configured to contact the surface of the piece of footwear, wherein the plurality of brushes includes at least one first brush configured to contact a first side surface of the piece of footwear, at least one second brush configured to contact a different, second side surface of the piece of footwear, and at least one third brush configured to contact a bottom surface of the piece of footwear, and wherein the at least one first brush and the at least one second brush are configured to, when actuated, rotate towards a center of the box about an axis that is substantially parallel to the bottom surface of the box.

The foregoing and other embodiments can each optionally include one or more of the following features, alone or in combination. The at least one third brush can be configured to, when actuated, rotate about the axis substantially parallel to the bottom surface of the box. The apparatus can further include an actuating control configured to, in response to receiving an actuating input from a user, actuate the first, second, and third brushes. Each of the plurality of brushes can be connected to a respective gear from a plurality of gears, wherein at least one of the plurality of gears is connected to a motor, and wherein the actuating control is configured to actuate the motor in response to receiving the actuating input. The apparatus can further include one or more sets of nozzles arrayed within the box, wherein each set of nozzles is configured to, when actuated, emit a pressurized spray of water at one of the surfaces of the piece of footwear. The apparatus can further include a container for receiving water emitted by the one or more sets of nozzles and debris removed from the piece of footwear by the emitted water and the plurality of brushes. The container can be removable. The container can contain a drain mechanism.

In general, another innovative aspect of the subject matter described in this specification can be embodied in an apparatus that includes a box having an open top surface for receiving a piece of footwear; a plurality of brushes arrayed within the box and positioned substantially parallel to a bottom surface of the box, wherein each of the plurality of brushes is configured to contact the surface of the piece of footwear, and wherein the plurality of brushes includes at least one first brush configured to contact a first side surface of the piece of footwear, at least one second brush configured to contact a different, second side surface of the piece of footwear, and at least one third brush configured to contact a bottom surface of the piece of footwear; and one or more sets of nozzles arrayed within the box, wherein each set of nozzles is configured to, when actuated, emit a pressurized spray of water at one of the surfaces of the piece of footwear.

The foregoing and other embodiments can each optionally include one or more of the following features, alone or in combination. Each of the plurality of brushes can be configured to, when actuated, rotate about an axis that is substantially parallel to the bottom surface of the box. Each of the one or more sets of nozzles can be connected to a pressurized water source. The apparatus can further include the pressurized water source. The pressurized water source can be an external water source. The apparatus can further include a valve interposed between each of the one or more sets of nozzles and pressurized water source, wherein, when closed, the valve shuts off a pressurized water flow from the pressurized water source to the one or more sets of nozzles, and wherein, when open, the valve permits the pressurized water flow, causing the nozzles to emit the pressurized sprays of water. The apparatus can further include a control configured to open and close the valve in response to inputs received from a user of the apparatus.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This specification generally describes a footwear cleaning device that removes debris, e.g., dirt or dust, from a shoe, boot, or other piece of footwear inserted into the device.

Figure 1:
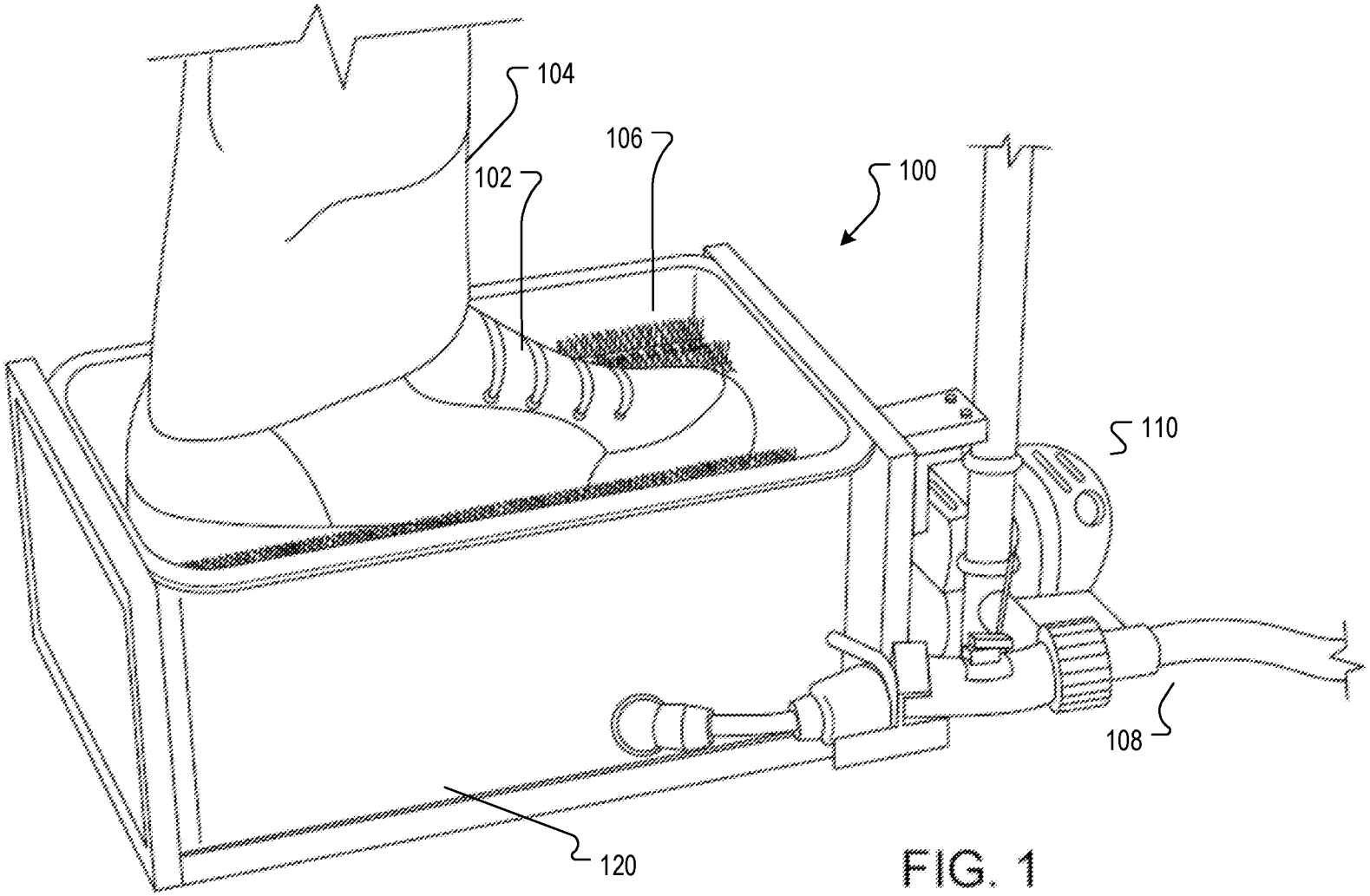
FIG. 1 is a diagram of an example footwear cleaning device.

FIG. 1 is a diagram of an example footwear cleaning device 100. Generally, the example footwear cleaning device 100 includes a box with an open top surface that allows a shoe 102 or other footwear being worn on a user's foot 104 to be inserted into the footwear cleaning device 100 to be cleaned by a set of brushes 106 while the user continues to wear the shoe 102, i.e., without forcing the user to remove the shoe 102 to have it cleaned. In particular, when inserted, the shoe 102 is contacted by brushes 106 that, when actuated, rotate to remove debris from the surfaces of the shoe 102. In order to cause the rotation of the brushes 106, the footwear cleaning device 100 includes a motor 110. In some implementations, the motor 110 is configured to connect to and draw power from an external power source, e.g., an external source of electricity. In some other implementations, however, the footwear cleaning device 102 includes an internal power source, e.g., one or more batteries or one or more solar panels, and the motor 110 is connected to the internal power source. The user can actuate and turn off the motor 110 by submitting an actuating input on a designated control. When operating, the motor 110 causes the brushes 106 to rotate in order to remove debris from the surfaces of the shoe 102 that are contacted by the brushes 106. The rotation of the brushes 106 is described in more detail below with reference to FIGS. 2 and 3.

Additionally, the device 100 is connected to a water source, e.g., via a hose 108 that allows the device 100 to receive a pressurized flow of water from an external water source. Alternatively, the device 100 may include a pressurized water source. For example, the device 100 may include or may be configured to attach to a pressurized water tank, a pressurized water pump, or both. The user can also submit an input that causes pressurized streams of water obtained from the external water source to be emitted by one or more nozzles arrayed within the device 100, with the streams being directed at the bottom surface of the shoe 102 that is inserted into the device 100 in order to remove dirt or other debris from the bottom surface of the shoe 102 that may not be otherwise removed by a dry cleaning while avoiding exposing other surfaces of the shoe 102 to water, e.g., because the other surfaces may not be made of a waterproof material. The operation of the nozzles arrayed within the device 100 will be described in more detail below with reference to FIG. 4.

As will be described below, the user may be able to submit a single input that initiates both the rotation of the brushes 106 and the pressurized water streams or separate inputs, with one input initiating the rotation of the brushes 106 and another causing the nozzles within the device 100 to emit the pressurized water streams.

The device 100 includes a container 120 at the bottom of the device that collects the debris that is cleaned from the shoe by the brushes 106 and the water that is emitted by the nozzles within the device 100 during operation of the device 100. In some implementations, the container 120 is removable from the device to allow for easy cleaning of the device 100. In some other implementations, the container 120 includes a drain mechanism for draining the contents of the container 120, allowing the device 100 to be effectively cleaned, e.g., by spraying down the device 100 with a hose.

Figure 2:
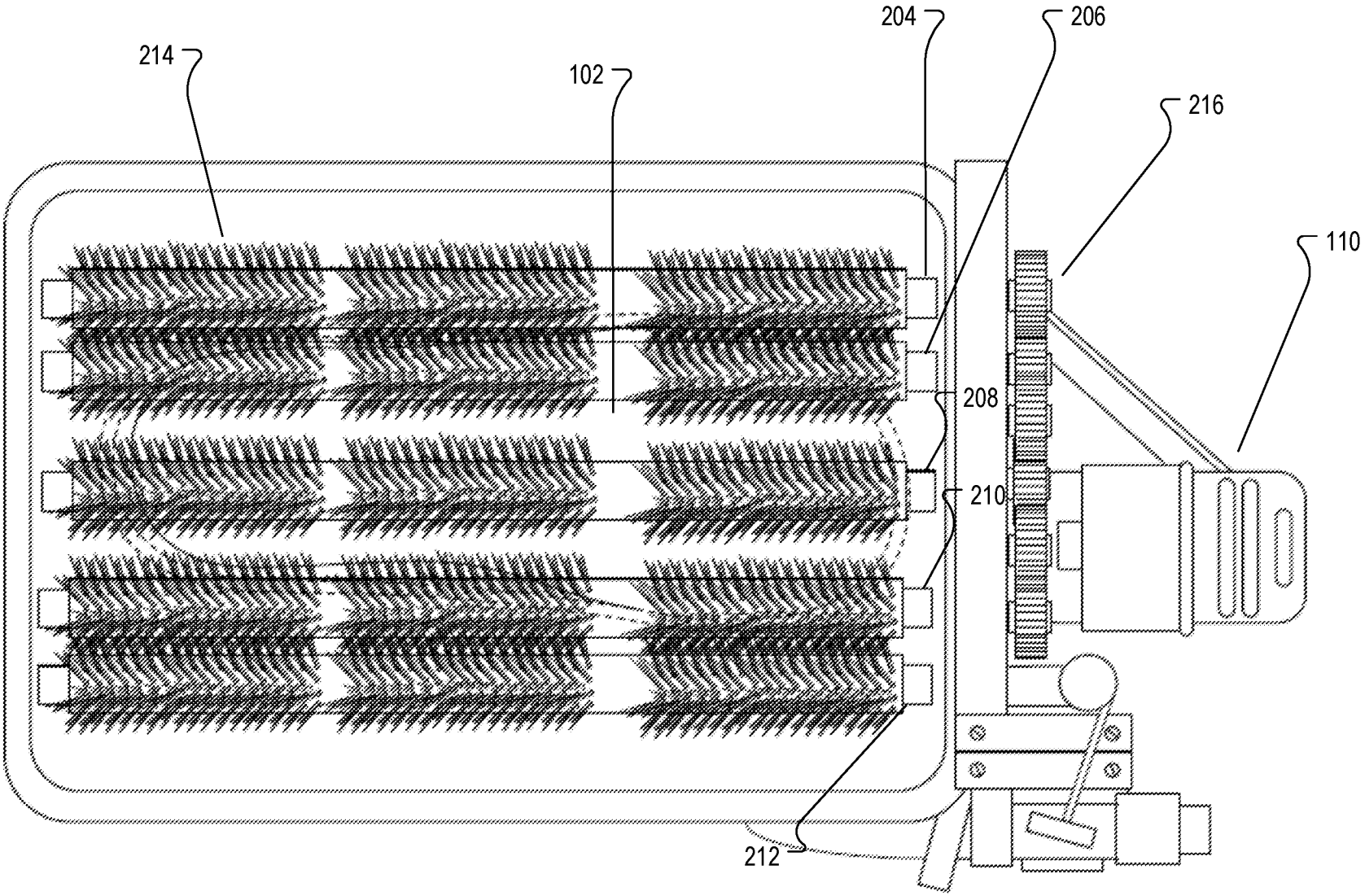
FIG. 2 is a diagram showing a top view of the example footwear cleaning device.

FIG. 2 is a diagram showing a top view of the example footwear cleaning device 100. In particular, FIG. 2 shows the shoe 102 inserted through the open top surface of the footwear cleaning device 100. The device 100 also includes brushes 204-212 that each have bristles 214 that contact the shoe 102, e.g., bristles 214 of the brush 204. Each of the brushes 204-212 is positioned substantially parallel to the bottom surface of the device 110 and is configured to contact the shoe 102, with brushes 204 and 212 being configured to contact the side surfaces of the shoe and brushes 206, 208, and 210 being configured to contact the bottom surface of the shoe. While the example of FIG. 2 shows five brushes 204-212, different implementations can include different numbers of brushes. Generally, the device 100 will include at least one brush that is configured to contact one side surface of the shoe, at least one brush that is configured to contact the other side surface of the shoe, and at least one brush that is configured to contact the bottom surface of the shoe. In some implementations, the positions of the brushes are adjustable, i.e., to account for different shoe sizes. That is, one or more of the brushes 204-212 may be movable to multiple positions to allow the movable brush to contact the surfaces of shoes of different sizes.

While the bristles 214 on the brush 204 in the example of FIG. 2 do not cover the entire surface of the brush 204, in some implementations, the bristles cover the entire surface of the brush. In some implementations, the bristles are a nylon material. Additionally, in some implementations, different brushes have bristles having different characteristics, e.g., different textures, toughness, and so on. For example, the brushes that are adapted to contact the bottom of the shoe may have tougher bristles in order to remove debris that is embedded in grooves on the bottom of the shoe, while the brushes adapted to contact the sides and top of the shoe may have softer bristles in order to avoid damaging or scuffing the shoe. Similarly, in some implementations, different brushes in the device 100 have different bristle arrangements, e.g., with different brushes having bristles covering different portions of the surface of the brush.

Each of the brushes 204-212 is configured to rotate in response to an actuating input that actuates the motor 110 by way of being connected to gears 216. Each of the brushes 204-212 is connected to a respective one of the gears 216, and at least one of the gears 216 is connected to the motor 110. When the motor 110 is actuated, the gears 216 are caused to rotate, which in turn causes each of the gears 204-212 to rotate. One example configuration of the gears 216 is described below with reference to FIG. 2. In particular, the brushes 204 and 212 that are configured to contact the side surfaces of the shoe 102 are configured to rotate towards the center of the device 100 and about an axis that is substantially parallel to the bottom surface of the shoe. The brushes 206, 208, and 210 are also configured to rotate about an axis substantially parallel to the bottom surface of the shoe, but in various implementations can rotate in various directions, e.g., with each of the brushes 206, 208, and 210 rotating in the same direction or with one of the brushes rotating in a different direction from the others.

Figure 3:
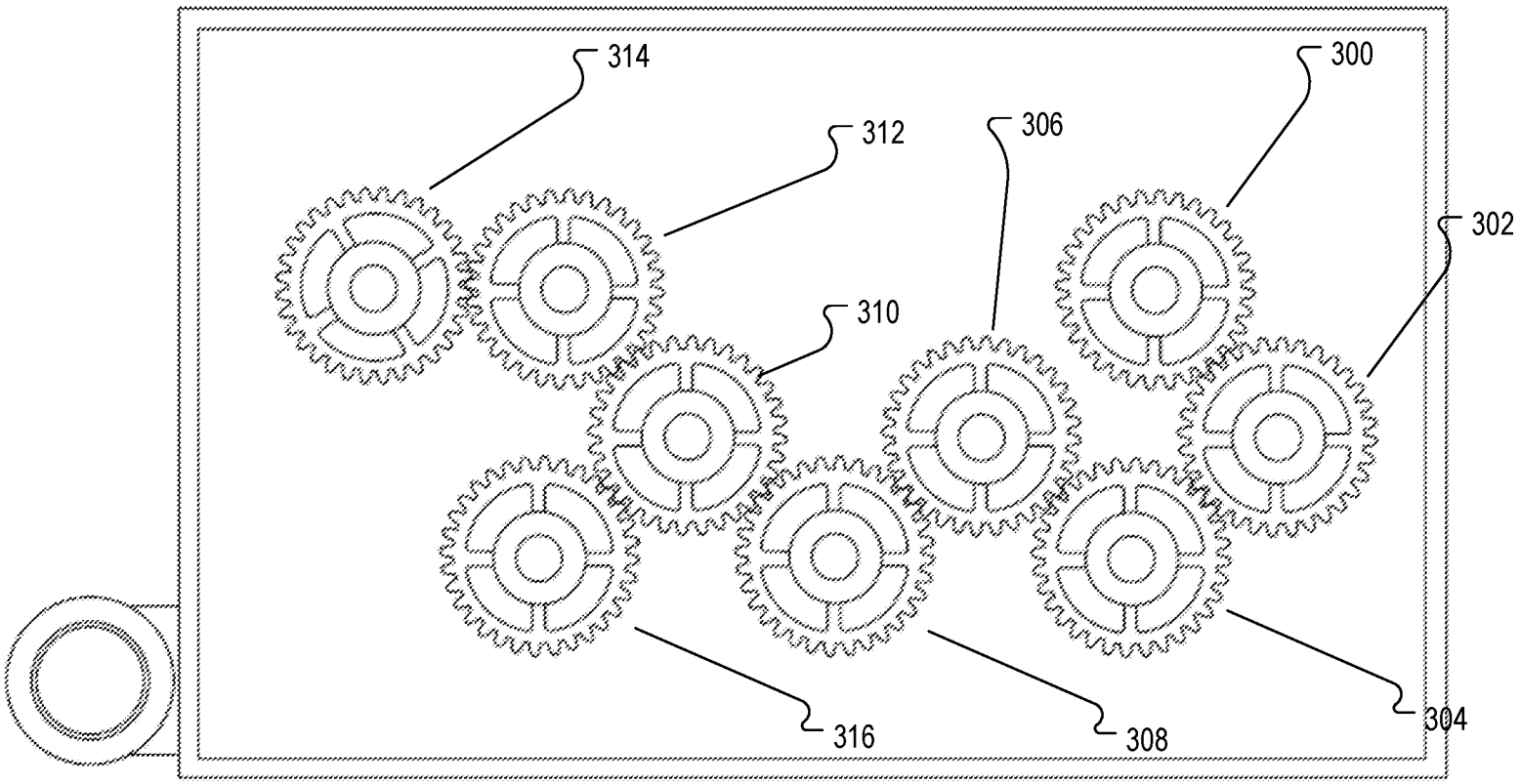
FIG. 3 is a diagram showing a configuration of gears on one of the sides of the example footwear cleaning device.

FIG. 3 is a diagram showing a configuration of gears on one of the sides of the example footwear cleaning device 100 that is operable to cause brushes within the device 100 to rotate. In particular, in the example of FIG. 3, the device 100 includes nine gears 302-316, with each gear being configured to contact one other gear, i.e., so that rotation of the gear causes rotation of the gear contacted by the gear. Some or all of the gears are connected to the brushes of the device 100 so that rotation of each gear that is connected to a brush causes the brush connected to the gear to rotate in the same direction as the gear and so that each brush is connected to a respective gear. For example, in one example configuration where the device 100 includes five brushes, gears 300, 304, 308, 314, and 316 may each be connected to a respective one of the five brushes, while gears 302, 306, 310, and 312 are not connected to a brush and are included in the set of gears to ensure that the brushes rotate in the desired direction.

At least one of the gears 302-316 is connected to a motor, e.g., the motor 110 of FIG. 1. When the motor is operating, the motor causes the gear or gears connected to the motor to rotate in a predetermined direction, causing a corresponding rotation of the remainder of the gears 302-316 and in the brushes that are connected to the gear. In particular, when the motor is actuated, the gears 300 and 314 that are connected to the brushes that are adapted to clean the side and top surfaces of the shoe are caused to rotate toward the center of the device 100, causing the corresponding gears to also rotate toward the center of the device 100 and about an axis that is substantially parallel to the bottom of the device 100 and substantially perpendicular to the side of the device to which the gears 302-316 are attached. By configuring the brushes that are adapted to clean the side and top surfaces of the shoe to rotate toward the center of the device, the amount of water being sprayed by the device 100 onto the bottom surface of the shoe and the amount of debris removed from the shoe by the brushes and that leaves the device 100 is minimized.

In some implementations, the motor may be configured to cause the gears to spin at multiple different speeds in response to different user inputs. For example, the device 100 may have a high-speed setting and a low-speed setting. When the low-speed setting is engaged by the user, the gears may be caused to rotate at a lower speed by the motor, thus causing the brushes to rotate at a lower speed. When the high-speed setting is engaged by the user, the gears may be caused to rotate at a higher speed by the motor, thus causing the brushes to rotate at a higher speed.

Figure 4:
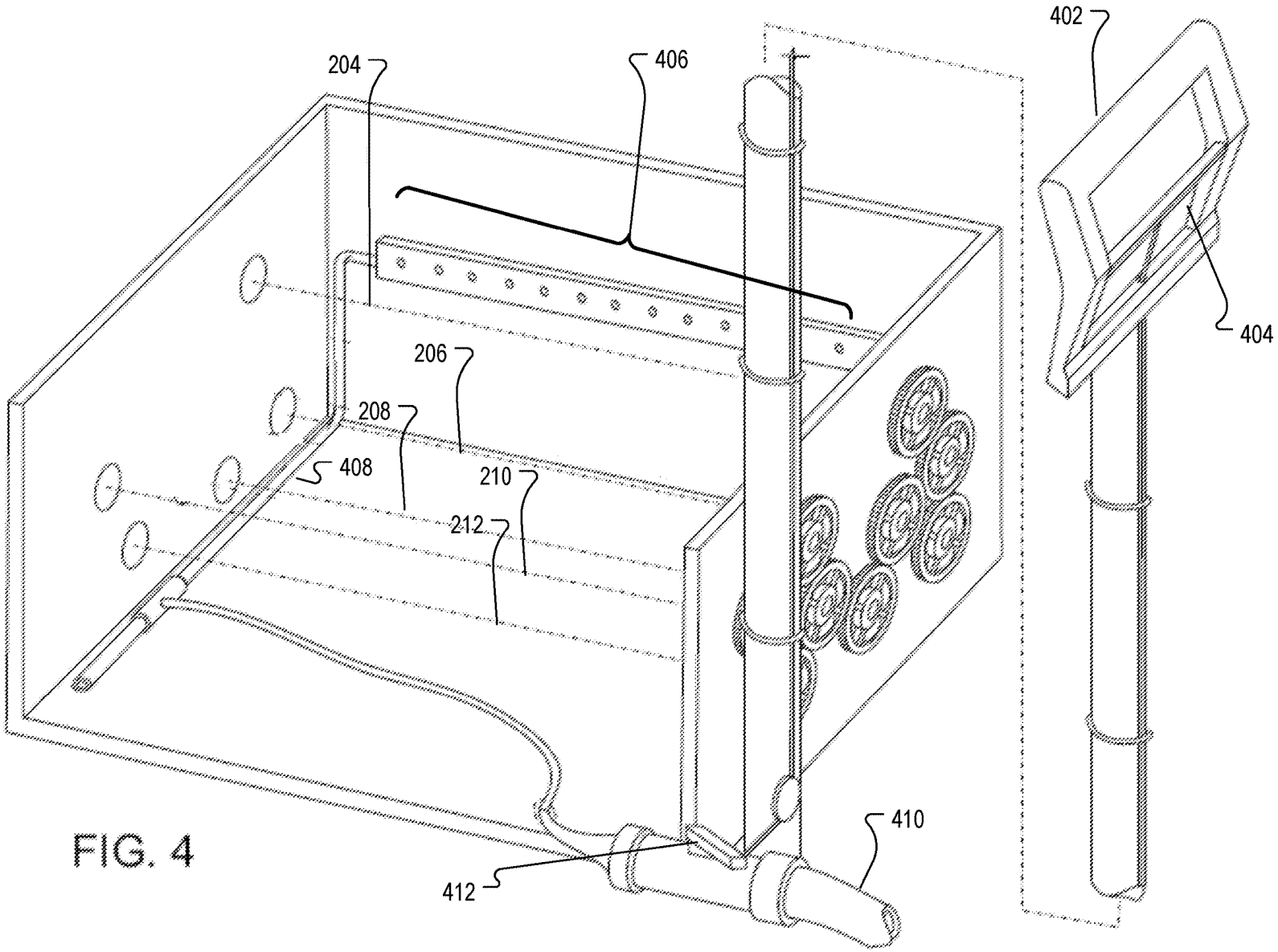
FIG. 4 is a diagram showing a side view of the example footwear cleaning device.

FIG. 4 is a diagram showing a side view of the example footwear cleaning device 100. The side view of the device 100 shows the five brushes 204-212, represented in FIG. 4 as dashed lines. The side view also shows a handle 402 that a user can grasp while using the device 100, i.e., to help the user balance while their shoe is being cleaned by the device 100. The side view also shows an actuating control 404 that the user can use to submit an actuating input that actuates the motor 110, causing the brushes 204-212 to rotate as described above, i.e., with brushes 204 and 210 rotating towards the center of the device 100 in order to remove debris from the top and side surfaces of a shoe and the brushes 206, 208, and 212 rotating to remove debris from the bottom surface of the shoe.

The side view also shows the mechanism by which water is delivered from a pressurized external source and emitted from a set of nozzles 406 located on the side of the device 100. The nozzles 106 are configured to emit a pressurized spray of water directed at a shoe that is inserted into device 100. While only one set of nozzles 406 is shown in the example of FIG. 4, various implementations can have various numbers of sets of nozzles that are located at various places within the device 100. For example, in some implementations, one set of nozzles is located at the bottom of the device 100 and configured to emit a pressurized spray of water at a bottom surface of a shoe inserted into the device 100. As another example, in some implementations, another set of nozzles is located on the side of the device that is opposite the set of nozzles 406. Generally, each set of nozzles 406 arrayed within the device 100 is configured to emit a pressurized spray of water onto one of the surfaces of the shoe at a predetermined angle.

Each set of nozzles is connected to an external water source. For example, the set of nozzles 406 is connected to a hose 410 by tubing 408. In order to allow the user to control the flow of water through the sets of nozzles, a valve 412 is positioned between the external water source and the sets of nozzles. In the example of FIG. 4, the valve 412 is positioned at a connector between the hose 410 and the tubing 408. However, the valve 412 may be interposed at various points between the sets of nozzles and the external water source. Generally, when the valve 412 is closed, the pressurized flow of water from the external water source to sets of nozzles is shut off. When the valve 412 is open, the flow of water from the external water source is opened, and the sets of nozzles emit pressurized sprays of water directed at the shoe that is inserted into the device 100. A user of the device 100 can control the flow of water by submitting an input on a designated control. Any of a variety of appropriate mechanisms for governing the position of the valve 412 may be used in response to a user input may be used. For example, the valve 412 may be opened and closed by compressing and decompressing a spring connected to the valve 412 in response to the user input. In some implementations, the valve 412 may be configured to govern the flow of water at multiple levels of granularity, e.g., partially open for a less pressurized spray of water or completely open for a more pressurized spray of water.

While FIG. 4 describes the device 100 being connected to an external pressurized water source by way of a hose 410, in some implementations the device 100 includes an internal pressurized water source, e.g., a pressurized water tank or an internal water source connected to a pressurized pump. In these implementations, the valve 412 may be positioned at a connector between the internal water source and the sets of nozzles.

In some implementations, the control that controls the position of the valve 412 and, therefore, whether water is being emitted by the sets of nozzles is the actuating control 404. That is, using the actuating control 404, the user may be able to control both the position of the valve 412 and the operation of the motor 110. In some other implementations, the control that controls the position of the valve 412 is separate from the actuating control 404. For example, the handle 402 may be movable to multiple positions, with one or more of the positions causing the valve to open and water to be emitted from the sets of nozzles, and with a different position causing the valve to close and water to cease being emitted from the sets of nozzles.

What is claimed is:

1. An apparatus for removing debris from footwear, the apparatus comprising:

a motor;

a box having an open top surface for receiving a piece of footwear;

at least one brush (i) residing within the box and (ii) configured to contact a surface of the piece of footwear, wherein the at least one brush is configured to be rotated by the motor in response to actuating of an actuator; and a first set of nozzles and a second set of nozzles within the box, wherein the first set of nozzles is located on a first side of the box, wherein the second set of nozzles is located on a second side of the box, and wherein the first set of nozzles and the second set of nozzles are configured to emit a pressurized spray of liquid at the surface of the piece of footwear in response to actuating of the actuator.

2. The apparatus of claim 1, wherein the at least one brush is configured to, when actuated, be rotated by the motor about an axis that is substantially parallel to a bottom surface of the box.

3. The apparatus of claim 2, wherein the at least one brush is configured to, when actuated, be rotated by the motor about the axis towards a center of the box.

4. The apparatus of claim 1, the apparatus further comprising:

a speed toggling unit, wherein the speed toggling unit is configured to change a rotation speed that the motor uses to rotate the at least one brush from a first rotation speed to a second rotation speed, wherein the first rotation speed is faster than the second rotation speed.

5. The apparatus of claim 1, further comprising:

a handle that is configurable to a particular position of multiple different positions.

6. The apparatus of claim 5, wherein the handle includes the actuator.

7. The apparatus of claim 1, wherein the liquid includes water.

8. The apparatus of claim 1, wherein the box includes a drain mechanism.

9. An apparatus for removing debris from footwear, the apparatus comprising:

a motor;

a box having an open top surface for receiving a piece of footwear;

a plurality of brushes arrayed within the box and positioned substantially parallel to a bottom surface of the box, wherein each brush of the plurality of brushes is configured to (i) contact a surface of the piece of footwear and (ii) be rotated by the motor in response to actuating an actuator, wherein the plurality of brushes includes at least one brush configured to contact a first side surface of the piece of footwear, at least one second brush configured to contact a different, second side surface of the piece of footwear, at least one third brush configured to contact a bottom surface of the piece of footwear; and a first set of nozzles and a second set of nozzles within the box, wherein the first set of nozzles is located on a first side of the box, wherein the second set of nozzles is located on a second side of the box, and wherein the first set of nozzles and the second set of nozzles are configured to emit a pressurized spray of liquid at a surface of the piece of footwear in response to actuating of the actuator.

10. The apparatus of claim 9, wherein the at least one brush of the plurality of brushes is configured to, when actuated, be rotated by the motor about an axis that is substantially parallel to the bottom surface of the box.

11. The apparatus of claim 10, wherein the at least one brush of the plurality of brushes is configured to, when actuated, be rotated by the motor about the axis towards a center of the box.

12. The apparatus of claim 10, wherein the at least one brush of the plurality of brushes is configured to, when actuated, be rotated by the motor about the axis away from a center of the box.

13. The apparatus of claim 9, the apparatus further comprising:

a speed toggling unit, wherein the speed toggling unit is configured to change a rotation speed that the motor uses to rotate the plurality of brushes from a first rotation speed to a second rotation speed, wherein the first rotation speed is faster than the second rotation speed.

14. The apparatus of claim 9, further comprising:

a handle that is configurable to a particular position of multiple different positions.

15. The apparatus of claim 14, wherein the handle includes the actuator.

16. The apparatus of claim 9, wherein the liquid includes water.

17. The apparatus of claim 9, wherein the box includes a drain mechanism.

* * * * *